United States Patent [19]

Ohashi et al.

[11] Patent Number: 4,754,304

[45] Date of Patent: Jun. 28, 1988

[54] DRUM CLEANING IN AN ELECTROPHOTOGRAPHIC COPYING MACHINE

[75] Inventors: Kunio Ohashi, Osaka; Yoshiaki Imanaka, Nara, both of Japan

[73] Assignee: Sharp Kabushiki Kaisha, Osaka, Japan

[21] Appl. No.: 352,582

[22] Filed: Feb. 26, 1982

[30] Foreign Application Priority Data

Feb. 27, 1981 [JP] Japan ..... 56-29048

[51] Int. Cl.[4] ..... G03G 21/00

[52] U.S. Cl. ..... 355/15; 430/125

[58] Field of Search ..... 355/3 R, 15; 430/125

[56] References Cited

U.S. PATENT DOCUMENTS

| | | | |
|---|---|---|---|
| 3,647,293 | 3/1972 | Queener | 355/15 |
| 4,142,165 | 2/1979 | Miyakawa et al. | 355/15 X |
| 4,183,655 | 1/1980 | Umahashi et al. | 355/15 X |
| 4,185,910 | 1/1980 | Nomura et al. | 355/15 |
| 4,361,922 | 12/1982 | Karal | 355/15 X |

*Primary Examiner*—Fred L. Braun

*Attorney, Agent, or Firm*—Birch, Stewart, Kolasch & Birch

[57] ABSTRACT

An electrophotographic copying machine includes a combined developing-cleaning magnetic brush element for selectively conducting the developing operation and the cleaning operation. During the first revolution of the drum, a bias voltage of −200 V is applied to the combined developing-cleaning magnetic brush element to conduct the developing operation. During the second revolution of the drum, a bias voltage of +30 V or zero (0) volts is applied to the combined developing-cleaning magnetic brush element to attract the inversely charged residual toner from the drum surface. During the third revolution of the drum, the bias voltage of −200 V is again applied to the combined developing-cleaning magnetic brush element to attract the positively charged residual toner from the drum surface.

6 Claims, 1 Drawing Sheet

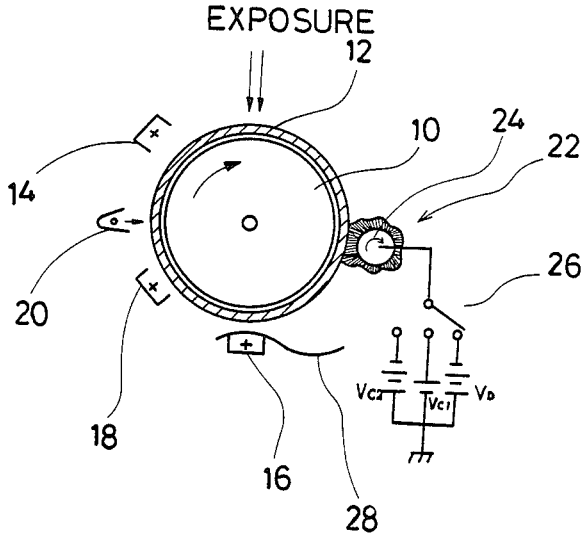
EXPOSURE
12
10
24
22
14
20
26
18
16
28
Vc2
Vc1
Vb

DRUM CLEANING IN AN ELECTROPHOTOGRAPHIC COPYING MACHINE

BACKGROUND AND SUMMARY OF THE INVENTION

The present invention relates to a cleaning method in an electrophotographic copying machine for removing residual toner from a drum surface.

The present invention relates, more particularly, to a cleaning system employing a combined developing-cleaning magnetic brush unit.

In an electrophotographic copying machine employing a photosensitive drum around which a charging unit, an exposure unit, a developing unit and a transcription unit are disposed, a cleaning unit is inevitably required to remove residual toner from the drum surface before conducting the next copying operation.

An electrophotographic copying machine has been proposed, wherein the photosensitive drum is rotated more than one complete revolution to produce one sheet of copy. In such an electrophotographic copying machine, a combined developing-cleaning unit can be employed, which performs the developing operation when the photosensitive drum rotates around the first time, and performs the cleaning operation when the photosensitive drum rotates around the second time.

A typical system of the above-mentioned electrophotographic copying machine is described in U. S. Pat. No. 3,647,293 entitled "COPYING SYSTEM FEATURING COMBINED DEVELOPING-CLEANING STATION ALTERNATELY ACTIVATED" issued on Mar. 7, 1972. In this system, a magnetic brush element performs the developing operation during the first revolution of the photosensitive drum. At the second revolution of the photosensitive drum, a bias voltage of the same polarity as the residual charge on the photosensitive drum surface is applied to the magnetic brush element for electrostatically attracting the residual toner from the photosensitive drum surface.

The present inventors have discovered that inversely charged toner is created while the copying operation is repeatedly conducted due to the deterioration of the developer mixture. The inversely charged toner can not be removed from the drum surface because the inversely charged toner has the same polarity as the bias voltage applied to the magnetic brush element during the cleaning step. If the inversely charged toner remains and accumulates on the photosensitive drum surface, a toner layer can be formed on the drum surface (which will be referred to hereafter as "toner filming layer"). The formed toner filming layer changes the physical and chemical characteristics of the drum, and affects the quality of the copy being produced.

Accordingly, an object of the present invention is to provide a novel cleaning method in an electrophotographic copying machine which employs a combined developing-cleaning magnetic brush element.

Another object of the present invention is to provide a cleaning method for effectively removing residual toner from a photosensitive drum surface in an electrophotographic copying machine wherein the photosensitive drum rotates more than one revolution to complete one sheet of copying operation.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a combined developing-cleaning magnetic brush element is disposed in an electrophotographic copying machine, which contacts the surface of the photosensitive drum. During the first revolution of the photosensitive drum, a bias voltage of, for example, −200 V is applied to the magnetic brush element to develop the latent image formed on the photosensitive drum surface. During the second revolution of the photosensitive drum, a bias voltage of, for example, +30 V or no bias voltage is applied to the magnetic brush element to remove the inversely charged toner from the photosensitive drum surface. During the third revolution of the photosensitive drum, a bias voltage of, for example, −200 V is applied to the magnetic brush element to attract the remaining residual toner from the photosensitive drum surface.

In a preferred form, when multiple sheets of copy are desired to be produced from one original sheet, the above-mentioned positive or no bias voltage step is omitted before the last sheet copy. When the transcription operation for the last copy sheet is completed, the positive bias voltage or no bias voltage is applied to the magnetic brush element to remove the inversely charged toner from the photosensitive drum surface. Then, the negative bias voltage is applied to the magnetic brush element for cleaning the residual toner.

BRIEF DESCRIPTION OF THE DRAWINGS

The present invention will be better understood from the detailed description given hereinbelow and the accompanying drawing which is given by way of illustration only, and thus is not limitative of the present invention and wherein:

The single drawing is a schematic view of an electrophotographic copying machine embodying the cleaning method of the present invention.

DESCRIPTION OF THE PREFERRED EMBODIMENTS

An electrophotographic copying machine related to the present invention generally comprises a drum 10 which is covered by a photosensitive material 12. The photosensitive material 12 preferably comprises an organic semiconductor which functions as the photosensitive image forming material when charged to a desired level of the negative polarity.

Around the drum 10, a uniform charging unit 14, a transcription unit 16, an erase corona unit 18 and an erase lamp 20 are disposed at desired positions. An optical system is provided for impinging a light image onto the photosensitive material 12 which is uniformly charged by the uniform charging unit 14.

A combined developing-cleaning unit 22 of the present invention is disposed near the drum 10 so that a magnetic brush element 24 contacts the photosensitive material 12. A bias switching system 26 is connected to the magnetic brush element 24 for selectively applying bias voltages $V_D$, $V_{C1}$ and $V_{C2}$ to the magnetic brush element 24. When the bias voltage $V_D$ is applied to the magnetic brush element 24, the combined developing-cleaning unit 22 functions to develop the latent image formed on the photosensitive material 12. When the bias voltage $V_{C1}$ is applied to the magnetic brush element 24, the combined developing-cleaning unit 22 functions to remove the inversely charged toner from the surface of the photosensitive material 12. When the bias voltage $V_{C2}$ is applied to the magnetic brush element 24, the combined developing-cleaning unit 22 functions to attract the residual toner from the surface of the photosensitive material 12.

An example of an operational mode or cycle will be described when two sheets of copy are desired to be produced from the same original, namely, when the electrophotographic copying machine is placed in the multi-copy mode.

[PREPARATION]

(1) When a copy button is actuated, the drum 10 beginnings to rotate, and the bias switching system 26 is switched to connect the magnetic brush element 24 to the bias voltage $V_D$. In a preferred mode, the bias voltage $V_D$ is −200 V.

(2) A copy paper is transferred from a copy paper cassette to a waiting section provided near the transcription unit 16. The erase lamp 20 is energized. The energization of the erase lamp 20 is continuously conducted till the multi-copy operation is completed.

[FIRST REVOLUTION]

(3) The uniform charging unit 14 is activated for uniformly charging the surface of the photosensitive material 12 to a desired level of a negative polarity.

(4) A light image is impinged on the surface of the photosensitive material 12 through the use of the optical system, thereby forming a latent image on the photosensitive material 12.

(5) As discussed above, the negative bias voltage $V_D$ (−200 V) is applied to the magnetic brush element 24. The toner charged to a predetermined positive voltage level due to the friction between the toner and the carrier is transferred to the surface of the photosensitive material 12 by means of the rotation of the magnetic brush element 24. The thus transferred toner is attracted by the dark portion of the latent image to form a developed image on the photosensitive material 12. The negative bias voltage $V_D$ is selected at a level so that the toner does not attach to the light portion of the latent image.

(6) The copy paper held at the waiting section is driven to travel toward the transcription unit 16. The developed image formed on the photosensitive material 12 is transcribed onto the copy paper 28 while the copy paper 28 travels through the transcritpion unit 16.

(7) The erase corona unit 18 is energized to erase the remaining image in combination with the continuously energized erase lamp 20. The uniform charging unit 14 is deenergized.

[SECOND REVOLUTION]

(8) The optical system is deenergized not to conduct the exposure operation. The bias switching system 26 is switched for connecting the magnetic brush element 24 to the bias voltage $V_{C2}$. In a preferred form, the bias voltage $V_{C2}$ is −200 V. Accordingly, the switching operation is not required when the operation is advanced from the first drum rotation to the second drum rotation. At this moment, the surface of the photosensitive material 12 is held near the ground level and, therefore, the residual toner is attracted from the photosensitive material 12 to the magnetic brush element 24 due to the electrostatic attracting force.

(9) The transcription unit 16 is deenergized at the second revolution. Another copy paper is transferred from the copy paper cassette to the waiting section for preparing for the copying operation onto the second sheet. At the end of the second revolution the bias switching system 26 is switched to connect the magnetic brush element 24 to the bias voltage $V_D$. This switching operation is not required in the above-mentioned preferred form, because the bias voltage $V_D$ and the bias voltage $V_{C2}$ have the same level −200 V.

[THIRD REVOLUTION]

(10) same as the above-mentioned step (3)
(11) same as the above-mentioned step (4)
(12) same as the above-mentioned step (5)
(13) same as the above-mentioned step (6)
(14) same as the above-mentioned step (7)

In this way, the copying operation onto the second sheet is conducted while the drum 10 rotates through its third revolution. Then, the operation is advanced to the fourth revolution, which is an essential part of the cleaning method of the present invention.

[FOURTH REVOLUTION]

(15) The optical system is deenergized not to conduct the exposure operation. The bias switching system 26 is switched in order to connect the magnetic brush element 24 to the bias voltage $V_{C1}$. In a preferred form, the bias voltage $V_{C1}$ is +30 V. At this moment, the surface of the photosensitive material 12 is held near the ground level and, therefore, the residual toner of the positive polarity will not be attracted by the magnetic brush element 24. Contrarily, a slight amount of additional toner of the positive polarity will be transferred onto the surface of the photosensitive material 12. However, if the inversely charged toner exists on the surface of the photosensitive material 12, the residual toner of the negative polarity is attracted by the magnetic brush element 24.

That is, the step (15) is to remove the negative toner from the surface of the photosensitive material 12. This cleaning operation is well conducted even when the bias voltage $V_{C1}$ is selected at the ground level. This is because the electrostatic attracting force is created between the magnetic brush element 24 and the negative toner disposed on the surface of the photosensitive material 12.

(16) The erase corona unit 18 is energized to completely erase the remaining image on the photosensitive material 12 in combination with the continuously energized eras lamp 20. The uniform charging unit 14 is never energized.

When the sub-cleaning operation of the fourth revolution is completed, the residual toner on the photosensitive material 12 does not include the inversely charged toner.

[FIFTH REVOLUTION]

(17) The uniform charging unit 14 is never energized during the fourth and fifth rounds. The optical system is not energized as in the case of the fourth revolution. The bias switching system 26 is switched in order to connect the magnetic brush element 24 to the bias voltage $V_{C2}$. In a preferred form, the bias voltage $V_{C2}$ is −200 V. At this moment, the surface of the photosensitive material 12 is held near the ground level and the residual toner does not include the negative toner. Thus, the residual toner is completely attracted by the magnetic brush element 24.

(18) At the end of the fifth round, the erase corona unit 18 and the erase lamp 20 are deenergized, whereby the copying machine is ready for the next actuation of the copy button.

The sub-cleaning operation of the steps (15) and (16) is to prevent the creation of the toner filming layer. Therefore, the sub-cleaning operation of the steps (15) and (16) is conducted at the end of the multi-sheet copying operation. In this way, the copying operation is conducted in a substantially same period as the conventional system such as the one disclosed in U.S. Pat. No. 3,647,293.

If ten (10) sheets of copy are desired to be obtained from the same original in the multi-copy mode, the steps (3) through (9) are repeated nine (9) times. Then, the operation is returned to the step (3) to copy the tenth sheet. When the copying operation onto the tenth sheet is completed at the step (7), the operation is advanced to the step (15) to execute the sub-cleaning operation of the present invention. Then, the steps (16), (17) and (18) are conducted to place the copying machine in condition ready for the next actuation of the copy button.

When the copying operation is conducted in the single-copy mode, that is, when one sheet of copy is desired to be obtained, the operation of the steps (8) through (14) are omitted. That is, the copying operation is conducted in the following order.

step (1), step (2), step (3), step (4), step (5), step (6), step (7), step (15), step (16), step (17) and, then, step (18)

Accordingly, in the single-copy mode, the first revolution of the drum 10 is to conduct the normal copying operation wherein the magnetic brush element 24 is connected to the bias voltage $V_D$ (−200 V), the second revolution of the drum 10 is to conduct the sub-cleaning for removing the negative residual toner or inversely charged toner from the drum surface, wherein the magnetic brush element 24 is connected to the bias voltage $V_{C1}$ (+30 V or 0 V), and the third revolution of the drum 10 is to conduct the final cleaning operation for removing the entire residual toner disposed on the drum surface, wherein the magnetic brush element 24 is connected to the bias voltage $V_{C2}$ (−200 V).

The invention being thus described, it will be obvious that the same may be varied in many ways. Such variations are not to be regarded as a departure from the spirit and scope of the invention, and all such modifications are intended to be included within the scope of the following claims.

What is claimed is:

1. A developing-cleaning method in an electrophotographic copying machine capable of making one or multiple copies of an original sheet with a final copy representing either the only copy or the last of said multiple copies including a rotating photosensitive member, a uniform charging unit, an exposure unit for forming a latent image on said rotating photosensitive member, a combined developing-cleaning magnetic brush element for developing the latent image in one mode and for cleaning the surface of the rotating photosensitive member in another mode, a transcription unit, an erase unit for erasing the image formed on said rotating photosensitive member, and means for selectively applying at least two levels of bias voltages to said combined developing-cleaning magnetic brush element, the method comprising the steps of:

applying a first bias voltage of a first polarity corresponding to the polarity of said latent image to said combined developing-cleaning magnetic brush element when said rotating photosensitive member with said latent image rotates through at least a first revolution, thereby performing the developing operation;

applying a second bias voltage at ground level or at a second polarity opposite to the polarity of said first bias voltage to said combined developing-cleaning magnetic brush element as said rotating photosensitive member rotates through a first subsequent revolution after said final copy is made, thereby removing residual toner having developed the same first polarity of the first bias voltage from the surface of said rotating photosensitive member; and applying a third bias voltage to said combined developing cleaning magnetic brush element, said third bias voltage being of the same polarity as said first bias voltage, as said rotating photosensitive member rotates through a second subsequent revolution, thereby removing remaining residual toner having a polarity opposite to the polarity of said first bias voltage from the surface of said rotating photosensitive member to complete said cleaning.

2. The developing-cleaning method of claim 1, wherein said second bias voltage is at a polarity opposite to said first and third bias voltages.

3. The developing-cleaning method of claim 1, wherein said second bias voltage is selected at said ground level.

4. The developing-cleaning method of claim 1, wherein said third bias voltage has the same level as the first bias voltage.

5. The developing-cleaning method of claim 4, wherein said uniform charging unit and said exposure unit are activated only during said first revolution of said rotating photosensitive member.

6. The developing-cleaning method of claim 1, wherein at least two copies are produced and said second bias voltage is applied to said combined developing-cleaning magnetic brush element as said rotating photosensitive member rotates through a third revolution, if two copies are made, or through a next succeeding revolution following the last of a multitude of revolutions required to produce said multiple copies.

* * * * *